US005938393A

United States Patent [19]

Georg

[11] Patent Number: 5,938,393

[45] Date of Patent: Aug. 17, 1999

[54] CONTAINER VEHICLE WITH LOADING MEANS

[76] Inventor: Edgar Georg, Auf der Seelhardt 10, D-57638 Neitersen, Germany

[21] Appl. No.: 08/894,329

[22] PCT Filed: Dec. 16, 1996

[86] PCT No.: PCT/EP96/05658

§ 371 Date: Dec. 8, 1997

§ 102(e) Date: Dec. 8, 1997

[87] PCT Pub. No.: WO97/23393

PCT Pub. Date: Jul. 3, 1997

[30] Foreign Application Priority Data

Dec. 21, 1995 [DE] Germany ..... 295 20 278 U

[51] Int. Cl.[6] ..... B65F 3/02

[52] U.S. Cl. ..... 414/408; 414/492; 414/517; 414/525.6

[58] Field of Search ..... 414/406, 408, 414/492, 517, 525.2, 525.6

[56] References Cited

U.S. PATENT DOCUMENTS

| | | | |
|---|---|---|---|
| 3,140,787 | 7/1964 | Clar . | |
| 3,167,195 | 1/1965 | Jensen et al. | 414/408 |
| 3,202,305 | 8/1965 | Dempster et al. . | |
| 3,643,824 | 2/1972 | Partridge | 414/492 |
| 3,647,098 | 3/1972 | Smith | 414/492 |
| 3,841,505 | 10/1974 | Kent | 414/517 X |
| 4,096,959 | 6/1978 | Schäffler | 414/408 |
| 4,699,557 | 10/1987 | Barnes | 414/408 |
| 5,064,332 | 11/1991 | Edelhoff et al. | 414/408 |
| 5,203,669 | 4/1993 | Klossek et al. | 414/517 X |
| 5,474,413 | 12/1995 | Georg . | |
| 5,562,390 | 10/1996 | Christenson | 414/408 X |
| 5,741,107 | 4/1998 | Georg | 414/408 |

FOREIGN PATENT DOCUMENTS

| | | | |
|---|---|---|---|
| 218965 | 4/1987 | European Pat. Off. | 414/408 |
| 0295574 | 12/1988 | European Pat. Off. . | |
| 571821 | 12/1993 | European Pat. Off. | 414/408 |
| 2458903 | 6/1978 | Germany . | |
| 3825484 | 2/1990 | Germany | 414/517 |
| 3923736 | 1/1991 | Germany | 414/517 |
| 92 07 193 U | 9/1992 | Germany . | |
| 94 17 594 U | 2/1995 | Germany . | |
| 1373638 | 2/1988 | U.S.S.R. | 414/408 |
| 2223474 | 4/1990 | United Kingdom | 414/525.6 |
| 9100231 | 1/1991 | WIPO | 414/517 |
| 93/15981 | 8/1993 | WIPO . | |

*Primary Examiner*—James W. Keenan
*Attorney, Agent, or Firm*—Venable; George H. Spencer; Catherine M. Voorhees

[57] ABSTRACT

The invention relates to a vehicle with a collecting container which can be picked up and set down and is intended for pourable solids, in particular waste material. The container is arranged behind the driver's cab and has, at least in the area where the container end faces the driver's cab, a filling opening, open at the top, and a pressure plate extending inside. The vehicle also has a swivel arm arrangement which is pivotable across the driver's cab, picks up and empties containers and is articulated to a support frame arranged behind the driver's cab and connected securely to the vehicle chassis. The actuating means for the swivel arm arrangement and at least one thrust cylinder for displacing the pressure plate and locking means for fixing the collecting container to the support frame are arranged on the support frame.

9 Claims, 4 Drawing Sheets

CONTAINER VEHICLE WITH LOADING MEANS

BACKGROUND OF THE INVENTION

Vehicles for receiving and transporting pourable solids, particularly waste materials, having a collecting container that is disposed on the vehicle, behind the cab, are known from, for example, U.S. Pat. No. 3,140,787 or U.S. Pat. No. 3,202,305. In these known vehicles, also referred to as overhead loaders, a pivoting arm arrangement that is hinged to the collecting container picks up an individual, filled container located in front of the vehicle, pivots it over the cab and empties it into a filling opening which is open to the top and is disposed in the region of the end of the collecting container that faces the cab. To fill the collecting container as full as possible, a pressing plate is displaceably guided inside the collecting container.

The disadvantage of the known vehicles is that the collecting container either remains fixedly connected to the vehicle and the contents must be pushed out completely by the pressing plate for emptying via a flap disposed on the collecting container at the end of the vehicle. This requires a long and very costly telescopic cylinder that further reduces the available volume space. In a stationary collecting container, however, the pressure-medium supply presents no problems for the pivoting drive, which is typically hydraulic, and for the pressing cylinder for the pressing plate, because the corresponding pressure lines can be laid permanently (U.S. Pat. No. 3,140,787).

In a concept that includes a removable collecting container, the disadvantage is that, because the pivoting arm arrangement with its drives, and the pressing plate with its pressing cylinder, are seated on the collecting container, a detachable connection for the supply of pressure medium must be provided between the pressure-medium pump disposed on the vehicle and the hydraulic actuation means for the relevant device. The use of hydraulic plug-in connections of this type requires the utmost care and cleanliness in handling, because the infiltration of dirt particles can lead very quickly to disturbances in the hydraulics system. Moreover, this system is very complicated, since each container must be equipped with a pivoting arm arrangement and a pressing device.

WO 93/15981 further discloses a vehicle in which the pivoting arm arrangement and the pressing device are permanently disposed on the vehicle, while the associated, detachable collecting container is provided with a front-side opening that is connected to the emptying opening of the pressing device during operation. This system has the advantage that all of the actuating elements, such as the pivoting arm arrangement and the pressing device, which are preferably to be driven hydraulically, are fixedly connected to the vehicle, while the collecting container is configured as a closed sheet-metal container up to the filling opening at the front end, which is provided with a door. The disadvantage is that, for this system, special collecting containers must be used that are fairly complicated with respect to the sealing and closure of the filling opening.

SUMMARY OF THE INVENTION

It is the object of the invention to create a vehicle of the above type that has a collecting container that can be picked up and set down, the vehicle having a compact design, on the one hand, and permitting the use of collecting containers of simple design on the other hand.

According to the invention, to accomplish this object, a vehicle is provided with a collecting container for pourable solids, particularly waste materials, which container can be picked up and set down and is disposed behind the cab, and has, at least in the region of the end facing the cab, a filling opening that is open to the top and a pressing plate that is guided in the interior of the container, the vehicle further having a pivoting arm arrangement that is hinged to a holding frame disposed fixedly to the vehicle, behind the cab, which arrangement can pivot over the cab for picking up and emptying containers, with the actuating means for the pivoting arm arrangement and at least one thrust cylinder for displacing the pressing plate, and locking means for securing the collecting container to the holding frame being disposed on the holding frame. A vehicle configured in this manner has the advantage that, on the one hand, the preferably hydraulic actuating means, the pivoting arm arrangement, the locking means and the thrust cylinder are connected to the vehicle by way of the holding frame, and remain on it during changing of the collecting container. The collecting container itself is formed by a sheet-metal container that is at least partially open to the top and can be used not only on the vehicle of the invention, but can also be transported on other vehicles and filled from above with other loading means. The pressing plate in this case can either be formed directly by the front container wall on the side of the cab, or an additional pressing plate can be disposed in the interior of the collecting container. In the latter case, a relatively small opening must be provided in the front wall, through which the thrust cylinder can act on the pressing plate. Because the locking means for the collecting container are likewise disposed on the holding frame, when the pressing plate impacts, the reaction forces between the thrust cylinder on the one hand and the collecting container on the other hand are transmitted directly to the holding frame via the locking means, so the vehicle chassis remains force-free. Depending on the magnitude of the pressing force to be exerted on the pressing plate, and/or for structural reasons, two or more thrust cylinders can be provided instead of one thrust cylinder. The arrangement usefully comprises two thrust cylinders that operate in parallel and can be guided in parallel by a corresponding hydraulic synchronization control.

A practical embodiment of the invention provides that the piston rod of the thrust cylinder is hinged to the holding frame, and the cylinder body forms the movable part that acts on the pressing plate. This embodiment offers significant advantages for the pressure-medium supply effected in the region of the holding frame.

The movable part of the thrust cylinder is usefully detachably connected to the pressing plate. In a further advantageous embodiment of the invention, a connecting means is provided for connecting the thrust cylinder to the pressing plate; when the thrust cylinder thrusts forward against the pressing plate, the connecting means permits latching, and a forward and backward movement of the pressing plate in the latched state. If an empty collecting container is picked up by the vehicle and connected to the holding frame by way of the locking means, the thrust cylinder can also be connected to the pressing plate by way of the connecting means through a forward thrusting of the thrust cylinder. After one or a plurality of containers has been emptied into the collecting container, the quantity of solid material building up in front of the pressing plate can be pushed into the rear part of the collecting container, and the pressing plate can be retracted, leaving sufficient free space for filling with further material. After the rear region of the collecting container has been filled to the rear wall, the desired sealing of the solid material that has been filled into the collecting container can be effected with this process. The connecting means permits a free forward and backward movement of the pressing plate.

If the collecting container is to be lowered or set down by the vehicle after being completely filled, the connecting means can be opened with corresponding opening means. The opening means can be disposed on the inside wall of the container or on the holding frame, and be actuated by individually activatable actuation means, either manually or with pressure means. It is useful, however, if the actuation means are formed by simple, stationary elements in the container or on the holding frame, which means do not engage the connecting means for opening until the thrust cylinder retracts the pressing plate a short way from its end working position at the front container wall toward the container wall, so the opening elements can enter operational connection with the connecting means.

In a practical embodiment of the invention, it is provided that the thrust cylinder is oriented horizontally, and that holding means for the free end of the thrust cylinder are disposed on the holding frame. This ensures reliable fixing of the thrust cylinder if the vehicle is driven without a collecting container. It is useful if the holding means are configured to move freely within the limitation of a vertical plane. This ensures that, when the thrust cylinder latches into the snap closure of the pressing plate of a collecting container that has been picked up, deviations from the exact axial position that cannot always be structurally avoided can be compensated; at the same time, however, the thrust cylinder is held laterally to a sufficient extent to avoid lateral "swinging."

A useful embodiment of the invention further provides that the holding means extend around the movable end of the thrust cylinder in the retracted position, and release it during a forward thrust. Because the danger of angular deviations with respect to the ideal longitudinal cylinder axis cannot be avoided during pushing of the pressing plate into the collecting container, this measure ensures that the thrust cylinder is released transversely to its operating direction when the pressing plate is pushed into the collecting container, thus avoiding tipping due to deviations in dimensions and angles.

A further practical embodiment of the invention provides that the thrust cylinder is disposed to be secured to the holding frame in the upward-pivoted position. This measure permits the vehicle to also be used to transport other interchangeable containers or other interchangeable bodies, because the upward pivoting of the thrust cylinder causes it to no longer project beyond the rear vertical plane of the holding frame, thus providing the necessary free space for handling other interchangeable bodies.

In a further advantageous embodiment of the invention, it is provided that the filling opening of the collecting container has a lid arrangement with actuation means for opening and closing, which can be connected to at least one drive means disposed on the holding frame. In the simplest embodiment, the lid arrangement can be formed by a flap that can pivot toward the rear of the vehicle about an axis of rotation extending transversely to the longitudinal direction of the vehicle. It is also possible, however, to configure the lid arrangement from two lid flaps that can pivot transversely to the longitudinal direction of the vehicle at the longitudinal edge of the filling opening. It is particularly useful if a third lid flap is included in the arrangement of two lid flaps that pivot toward the outside, because this third flap provides wind protection for the open filling opening, and fine particles contained in the solid material to be filled cannot be carried off by the wind when the pivoting arm arrangement empties the container. Regardless of the selection of the above-described, different lid flap arrangement, one feature is common to all concepts, namely that the actuation means, in the form of levers, drawing rods or pressure rods, are seated on the collecting container, while the necessary actuation means, for example in the form of one or a plurality of hydraulic cylinders, are disposed on the holding frame of the vehicle. Only purely mechanical parts are disposed on the collecting container, while all of the elements for opening and closing the lid arrangement, which elements are to be supplied with actuation energy, are disposed on the holding frame, fixedly connected to the vehicle. When the collecting container is picked up, the actuation means are brought into engagement with the drive means, and released again from the drive means when it is set down.

BRIEF DESCRIPTION OF THE DRAWINGS

The invention is described in detail by way of embodiments illustrated in schematic drawings wherein.

DETAILED DESCRIPTION OF THE INVENTION

Figure 1:
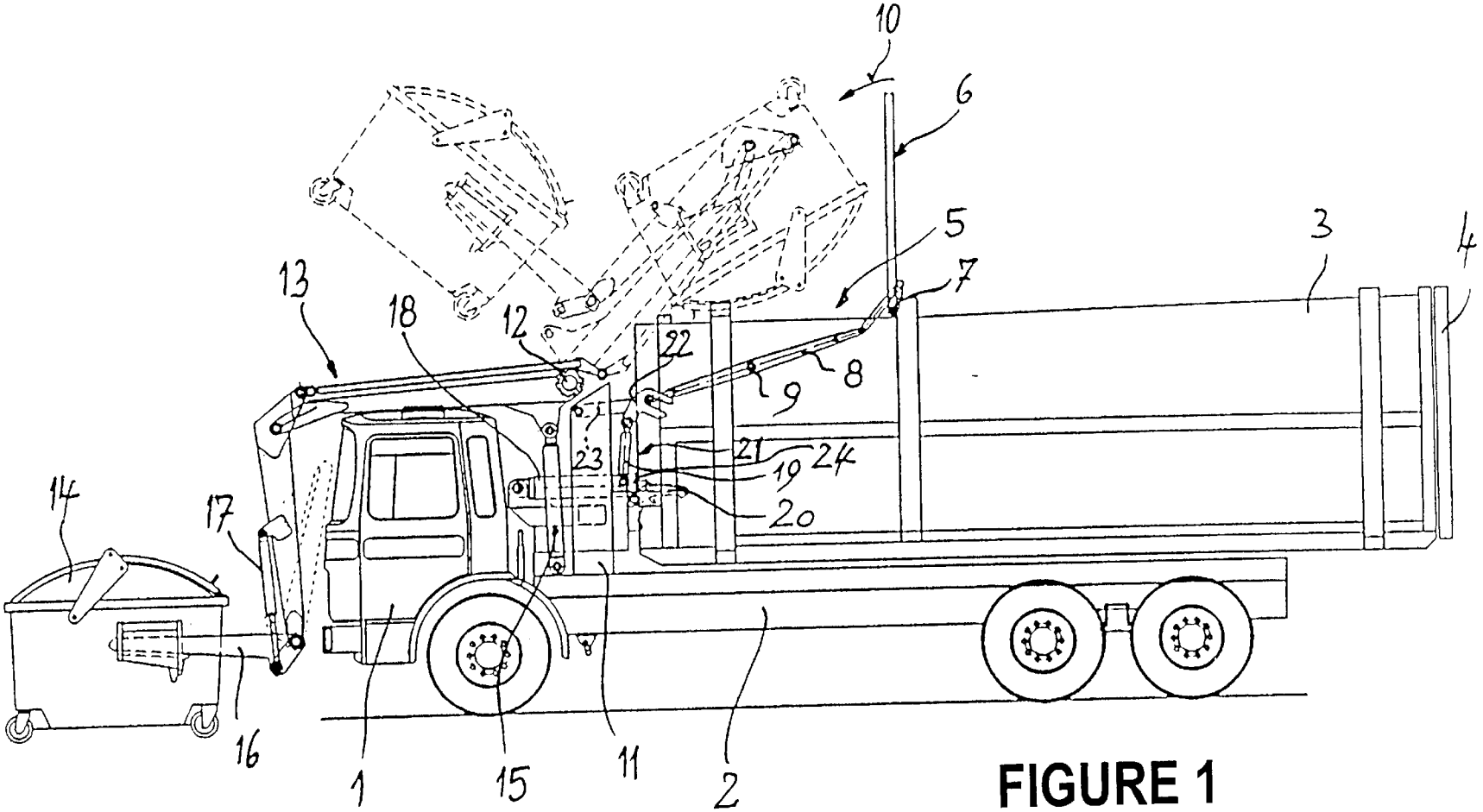
FIG. 1 is a side view of a vehicle according to the invention.

The vehicle shown in FIG. 1 has a chassis 2 that is provided with a cab 1 and on which a collecting container 3 is arranged so as to be picked up and set down. The collecting container can be picked up and set down in different ways, depending on the configuration of the vehicle or the collecting container. If the vehicle is equipped to pick up so-called interchangeable bodies, the collecting container 3 must be provided with four pivotable legs so that it can stand on the legs. The vehicle itself must be provided with a lowering device so that the vehicle can drive backwards under the standing collecting container in order to pick it up. The locking between the vehicle chassis 2 and the collecting container 3 is effected in a conventional manner.

The vehicle can also be provided with a so-called cable or chain pull. In this instance, the chassis is provided with a towing track that can be pivoted up into a diagonal position about a shaft extending at the rear of the vehicle, with which track the collecting container can then be set down or picked up with the aid of a cable or chain pull.

Finally, the vehicle can also be provided with a so-called hook lift, as described in detail below; this lift permits a pivoting arm provided with a gripper hook to extend into an eyelet disposed on the front side of the collecting container, and permits the front side of a collecting container standing on the ground to be lifted when the arm pivots; then the collecting container is drawn into its end position on the vehicle chassis 2 and locked to the chassis 2.

The collecting container 3 is provided at its back end with a lockable closing door 4, so the contents of the collecting container can be pushed and/or tipped out of the container after the closing door 4 has opened. At the end on the side of the cab, the collecting container 3 is provided with a filling opening 5, which is located at the top and can be closed by a lid arrangement 6. In the illustrated embodiment, the lid arrangement comprises only one lid part 6, which can pivot upward about a shaft 7 disposed at the rear end of the filling opening 5. The lid part 6 can be moved back out of the illustrated open position into the closed position (arrow 10) by an actuation means 8 in the form of a pivoting lever that can pivot about a hinge pin 9 that is rigidly connected to the collecting container 3.

A holding frame 11, which supports in the region of its upper crossbeam a pivot bearing 12 for a pivoting arm arrangement 13, is connected to the vehicle chassis 2, behind the cab 1. With the aid of this pivoting arm arrangement 13, also known as a so-called overhead loader, it is possible to pick up a container 14 located in front of the cab 1 and move it over the cab 1 in the direction of the filling opening 5 of the collecting container 3, and when a position above the filling opening 5 has been reached, the container can be emptied into the collecting container 3 through pivoting of the container 14. The relevant intermediate stations in this movement are shown in dashed lines in FIG. 1. The pivoting arm arrangement has two parallel, adjacent pairs of pivoting arms whose design and function are generally known.

The pivoting movement for the pivoting arm arrangement 13 is effected by at least one, preferably two hydraulic cylinder(s) 15 hinged to the holding frame 11 and acting on the pivoting arms in the region of the pivot bearing 12. During driving operation, the pivoting arm arrangement 13 is held in the pickup position; only the pickup fingers 16 disposed at the end of the pivoting arm arrangement are pivoted upward, by corresponding control means 17, into the traveling position shown in dashed lines.

At least one essentially horizontally-oriented thrust cylinder 18, whose free end 19 acts on a pressing plate that can be displaced back and forth in the collecting container 3, is further seated on the holding frame 11. This arrangement is explained in detail in conjunction with FIG. 2. Also provided on the holding frame 11 are hook-shaped locking means 20, which are shown in detail in FIG. 4 and can be used to lock the collecting container 3 securely to the holding frame 11.

An actuation means 21 for the lid arrangement 6 is further provided on the holding frame 11. This actuation means 21 essentially comprises a holding claw 22, which is hinged to the holding frame 11 by way of a connecting rod 23 and can be pivoted correspondingly by a hydraulic cylinder 24. The holding claw 22 of the actuation means extends around the free end of the pivoting lever 8 acting on the lid part 6. FIG. 1 shows the arrangement in the open position. The arm 23 is pivoted upward by the hydraulic cylinder 24 to close the filling opening 5; in the process, the opening of the holding claw 22 experiences a horizontal orientation. If the collecting container 3 is now displaced toward the back to be set down onto the vehicle, the lever arrangement 8 is no longer in engagement with the holding claw 22 of the actuation means, and the collecting container can be moved with a closed filling door.

Figure 2:
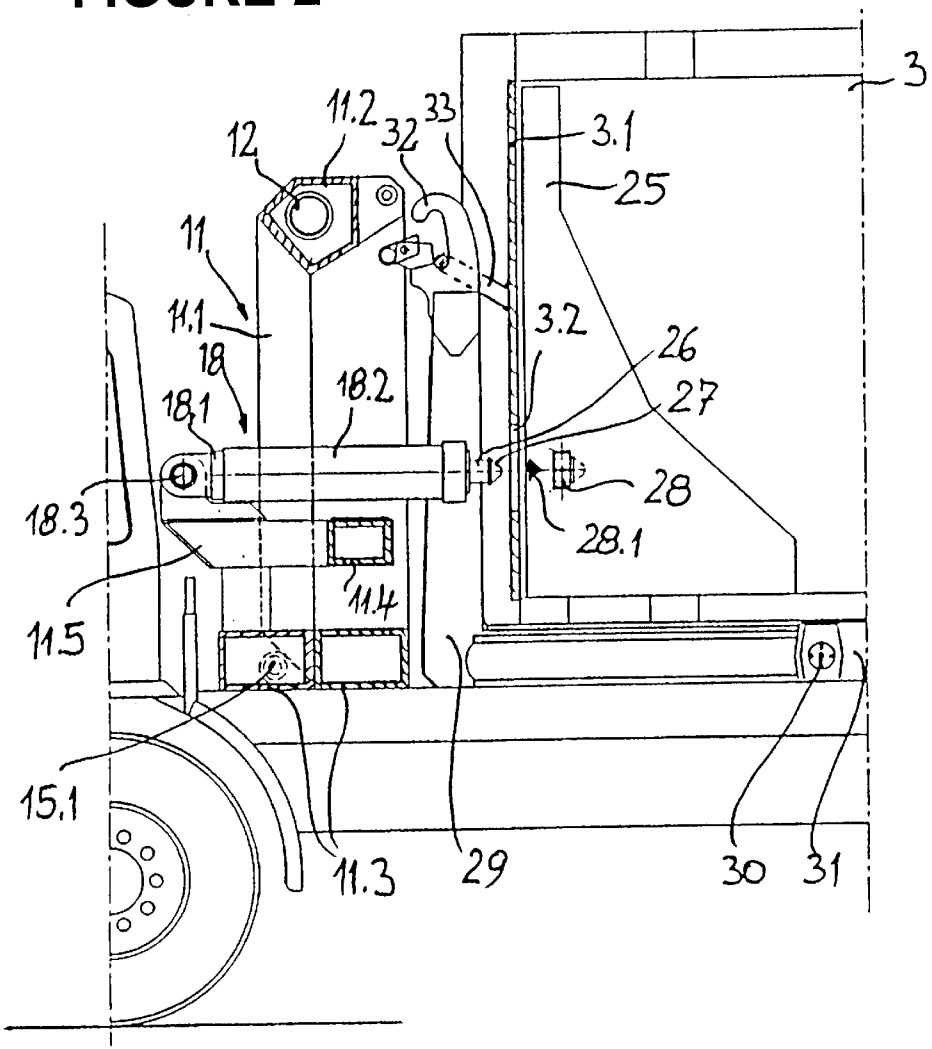
FIG. 2 is an enlarged view of the region between the cab and the collecting container on a vehicle according to FIG. 1.

FIG. 2 shows the region between the cab 1 and the collecting container 3 on an enlarged scale. In the embodiment of FIG. 2, the collecting container 3 is picked up and set down by a so-called hook lift. The design and function of the components described below are, however, not associated with the use of a hook lift for picking up and setting down the collecting container. The vehicle can also be equipped in the same manner for the other, above-described methods of picking up and setting down containers.

In the embodiment illustrated here, the holding frame 11 has two lateral stands 11.1, which are permanently connected to one another by way of at least one upper crossbeam 11.2 and a bottom crossbeam 11.3. The holding frame 11 is connected to the vehicle chassis 2 by way of the bottom crossbeam 11.3. The pivot bearing 12 for the pivoting arm arrangement 13 is disposed in the upper region of the holding frame 11. The hinge 15.1 for the hydraulic cylinder 15 for pivoting the pivoting arm arrangement 13 is disposed in the region of the lower crossbeam 11.3.

Disposed on a further crossbeam 11.4 is a fixed pivot bracket 11.5, to which the thrust cylinder 18 is hinged for actuating a pressing plate 25 that is displaceably guided inside the collecting container 3. The arrangement here is such that the piston rod 18.1 is respectively hinged to the fixed pivot bracket 11.5, while the cylinder body 18.2 forms the movable part. The free end of the cylinder body is provided with a head pin 26, which has a conical head 27.

A connecting means 28, for example in the form of a snap closure, is associated with the head pin 26 at the pressing plate 25. A through-opening 3.2 is provided in the front container wall 3.1, at the height of the connecting means 28. If the cylinder body 18.2 is thrust forward against the pressing plate due to an exertion of pressure, the head pin 26 enters operational connection with the connecting means 28. In the configuration of the connecting means 28 as a snap closure, the snap closure is opened by the conical head 27 of the head pin 26, and latches, so a form-fitting connection is produced between the thrust cylinder 18 and the pressing plate 25. The pressing plate 25 can be moved forward and backward without causing the connecting means to open.

If the collecting container 3 is now to be set down, the connecting element 28 must be released so the thrust cylinder 18 can be retracted completely. This release can be effected either externally by hand or with additional means that can be actuated with an additional hydraulic cylinder, for example a small hydraulic cylinder disposed on the outside of the cylinder body 18.2 and traveling forward toward the connecting means 28 for release. It is also possible, however, to provide a separating element 28.1 on the inside of the front container wall, which element engages the connecting element 28 during a controlled overshoot of the end position provided for normal operation, for example when the connecting element is configured as a spring-loaded snap closure, and opens the closure so the thrust cylinder can be freely retracted. After the thrust cylinder 18 has been retracted, the locking elements 20 are also released.

In the embodiment described in conjunction with FIG. 2, the collecting container 3 is picked up and set down by a so-called hook lift. The lift essentially comprises an angular arm 29 that is connected by a joint 30 to a tipping bridge 31 that is hinged in the rear region of the vehicle. At its free end, the angular arm 29 has a hook 32, which engages a corresponding eyelet 33 secured to the front wall 3.1 of the collecting container 3. Following the release of the thrust cylinder 18, the collecting container can be displaced toward the back on the vehicle through the upward pivoting of the angular arm 29 by actuation means, for example hydraulic cylinders whose design and function are known, and released from a locked state with the tipping bridge 31 and displaced toward the back on the bridge by a predetermined distance. For setting the container down completely, the tipping bridge can then be raised, and the collecting container can be completely set down on the ground through a further pivoting of the angular arm 29 with a simultaneous forward movement of the vehicle. A collecting container 3 is picked up in the reverse order of events. If the collecting container is to be emptied without being set down, the rear closing door 4 is opened and the tipping bridge 31 is pivoted upward with the collecting container 3, which is still locked to it, so the collecting container can be emptied like a normal tipper.

Figure 3:
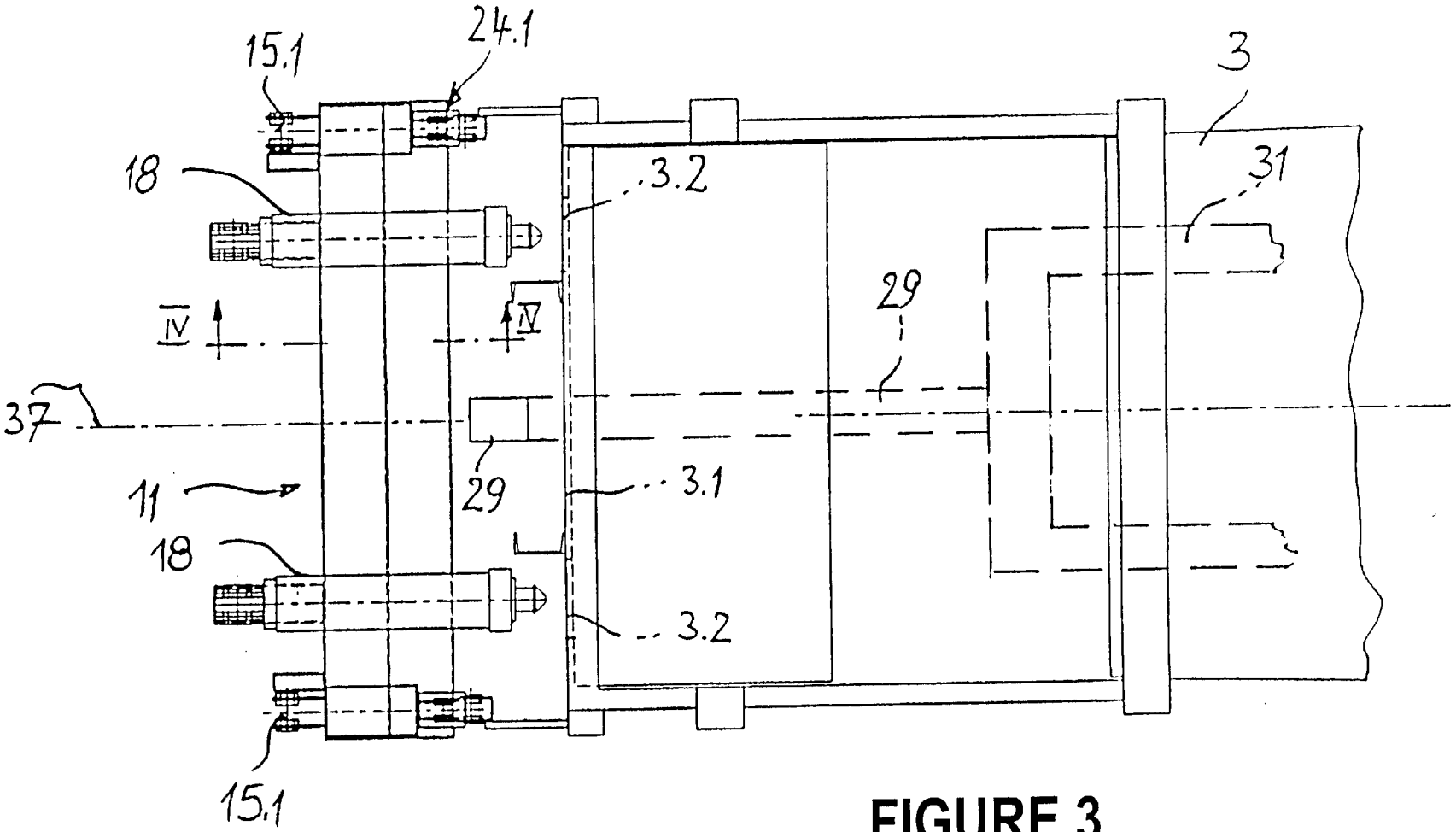
FIG. 3 is a plan view of the region according to FIG. 2.
Figure 6:
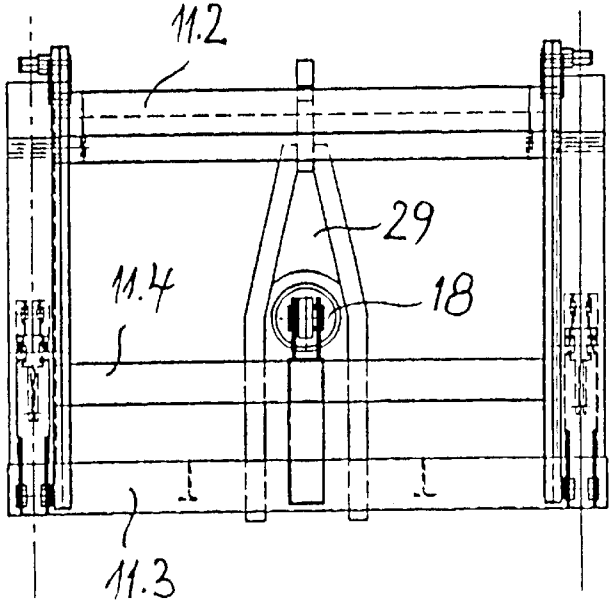
FIG. 6 is an embodiment that includes a thrust cylinder.

FIG. 3 shows the region between the cab 1 and the front wall of the collecting container 3 in plan view, with the upper crossbeam 11.2 of the holding frame 11 removed. As the plan view shows, in this embodiment two thrust cylinders 18 are provided that can travel through the associated openings 3.2 in the front wall 3.1 of the collecting container 3, on both sides of the angular arm 29. This arrangement ensures that the angular arm 29 can be pivoted alone or with the tipping bridge 31 after the thrust cylinders 18 have been retracted. It is also possible, however, to provide only one thrust cylinder, which then extends in the vertical, center longitudinal plane 37. In this instance, it is necessary for the vertical arm part of the angular arm 29 to be embodied in the form of a U or V that is open to the bottom, so both legs of the vertical arm part extend beyond the thrust cylinder from above and, again, after the release of the thrust cylinder from the pressing plate, the angular arm can be pivoted freely by itself or with the tipping bridge, as shown in a front view in FIG. 6.

Figure 4:
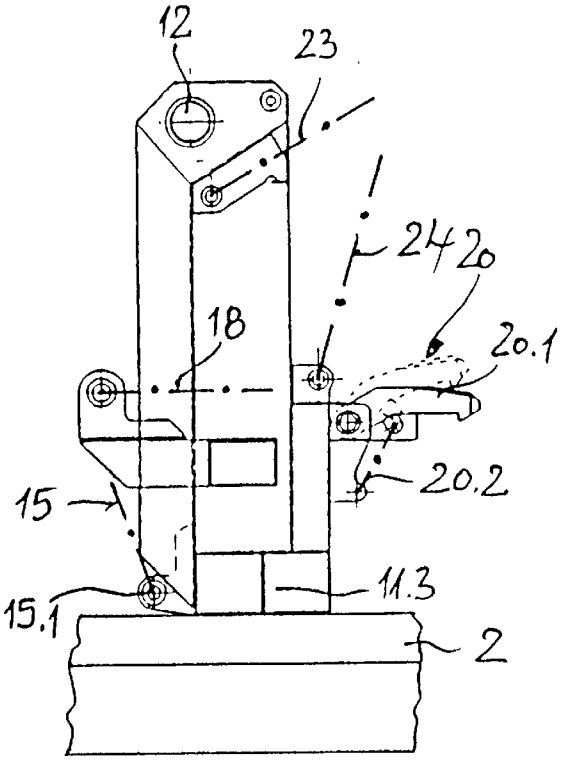
FIG. 4 is a partial representation of a locking means.

FIG. 4 shows the arrangement of the locking means 20 in a vertical section according to line IV—IV in FIG. 3. The other elements are only shown in dot-dash lines and are provided with the associated reference numerals. The locking means 20 essentially comprises a hook 20.1 that can be pivoted upward by a small hydraulic cylinder 20.2; at the free end, its hook part can be brought into engagement with a correspondingly-configured eyelet in the front region of the collecting container 3.

Figure 5:
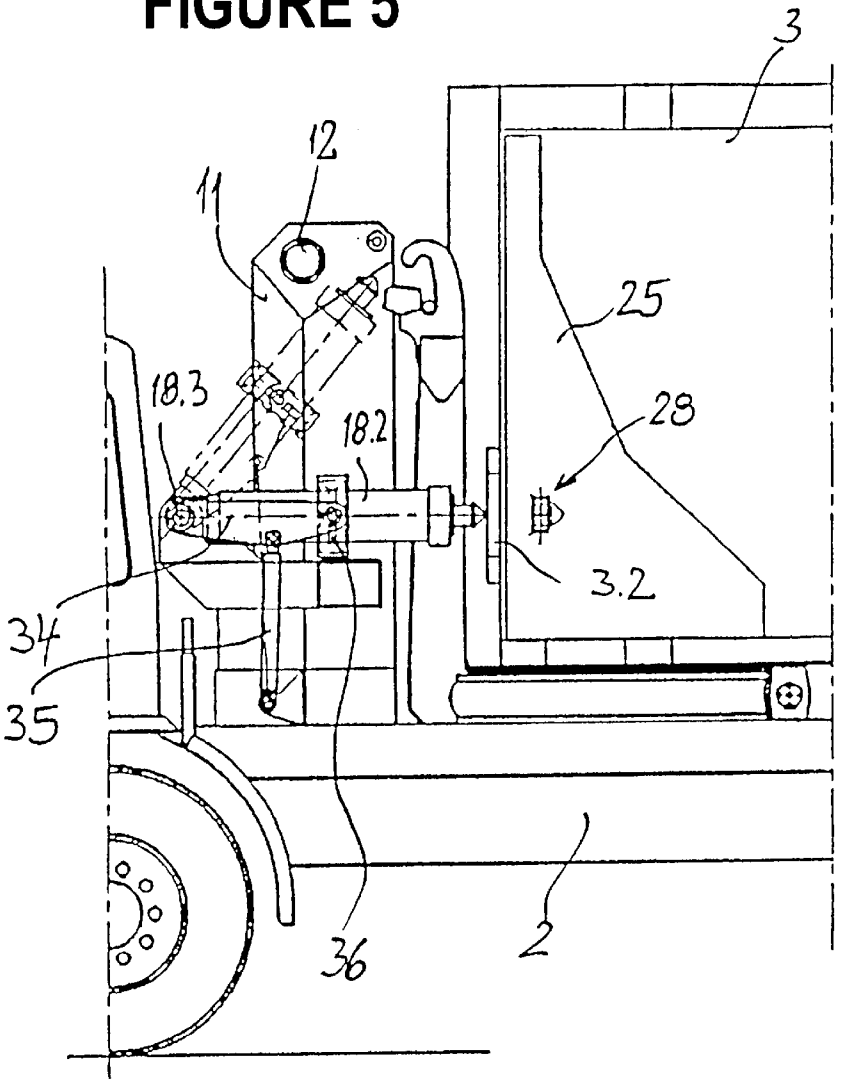
FIG. 5 is a modified embodiment of the arrangement according to FIG. 2.

FIG. 5 shows a modification of the embodiment described in conjunction with FIG. 2. In terms of function and design, the individual elements correspond to the embodiment described in conjunction with FIG. 2. In the embodiment of FIG. 5, a pivoting arrangement 34 is provided for the thrust cylinder 18; with this arrangement, the thrust cylinder 18 can be pivoted upward, with the aid of a hydraulic cylinder 35, out of the position extending beyond the rear plane of the holding frame 11, so the free end of the thrust cylinder 18 is held inside the holding frame 11. The pivoting device essentially comprises two lateral cheeks having a holding means 36 at their end facing away from the hinge 18.3 above the thrust cylinder; this holding means encompasses the cylinder body 18.2. The holding means 36 is usefully embodied to provide a freedom of movement limited to the vertical plane, so a bend-free lateral deflection is possible when the cylinder body 18.2 is thrust forward against the pressing plate 25. To this end, a spherical seating is provided for the hinge 18.3 of the thrust cylinder 18. As soon as the rear end of the cylinder body 18.2 has been displaced beyond the holding means 36 shortly after the locking engagement with the connecting means 28 at the pressing plate 25, the total lateral freedom of movement without contact with the holding means 36 is provided in the dimensions that are relevant here. This type of holding means 36 can also be used in an embodiment described in conjunction with FIG. 2, in which the thrust cylinder 18 also remains in its horizontal orientation after the collecting container 3 has been set down.

The above-described option of upward pivoting for the thrust cylinder 18 in the arrangement of two parallel thrust cylinders as described in conjunction with FIG. 3 correspondingly exists for transporting normal collecting containers with the vehicle, because the front wall of the containers can be guided up closely to the holding frame 11. This applies for both the described embodiment that includes the hook lift as well as the embodiments described at the outset, which involve interchangeable bodies and T-bar lifting.

As can be inferred from FIG. 3, the above vehicle concepts also permit the use of a collecting container that is subdivided by one or a plurality of longitudinal walls, so through corresponding shaking, sorted, prepared waste can also be picked up separately from the collecting container. It is possible to provide a separate pressing plate for each partial space, with a thrust cylinder being associated with each pressing plate. For an arrangement according to FIG. 3, a longitudinal wall and two pressing plates would be provided, and would be able to enter operational connection with one of the thrust cylinders 18. The thrust cylinders 18 could then be actuatable simultaneously and independently of one another. The pickup apparatus on the pivoting arm arrangement 13 would have to be adapted to the correspondingly smaller container.

I claim:

1. A vehicle having a chassis comprising:

a cab;

a collecting container for pourable solids, said collecting container disposed behind the cab and capable of being picked up and removed from the vehicle, said collecting container having an interior, an end, a top, a filling opening on the top of the collecting container at least in a region of its end facing the cab, and a pressing plate that is guided through the interior of the collecting container;

a holding frame disposed behind the cab and fixedly connected to the vehicle chassis;

locking means for securing the collecting container to the holding frame;

a pivoting arm arrangement that can pivot over the cab for picking up and emptying containers into the collecting container, said arrangement being hinged to the holding frame, wherein actuation means for the pivoting arm arrangement and at least one thrust cylinder are disposed on the holding frame in order to displace the pressing plate, the at least one thrust cylinder has a movable part which can be connected to the pressing plate by a connecting means, and means for opening the connecting means which permit the movable part of the thrust cylinder to latch to the pressing plate when the thrust cylinder is thrust forward against the pressing plate, the connecting means permitting a forward and backward movement of the pressing plate when the movable part of the thrust cylinder is latched to the pressing plate.

2. The vehicle according to claim 1, wherein the thrust cylinder is a piston with a piston rod hinged to the holding frame and a cylinder body of the piston is the moveable part.

3. The vehicle according to claim 1, wherein the thrust cylinder is disposed horizontally, and holding means are provided for supporting a free end of the thrust cylinder on the holding frame.

4. The vehicle according to claim 3, wherein the holding means are configured to move freely within the limitation of a vertical plane.

5. The vehicle according to claim 3, wherein the holding means extend around the movable end of the thrust cylinder in the retracted position, and release it during forward displacement when the pressing plate is moved.

6. The vehicle according to claim 1, wherein the thrust cylinder is disposed to be secured to the holding frame when in an upward-pivoted position.

7. The vehicle according to claim 1, wherein the filling opening of the collecting container has a lid arrangement that includes lid actuation means for opening and closing the lid arrangement, the lid actuation means can be detachably connected to at least one drive means disposed on the holding frame.

8. The vehicle according to claim 1, wherein the collecting container has a stationary front wall that is respectively provided with a recess for the thrust cylinder.

9. The vehicle according to claim 1, wherein a hook lift arrangement is provided for picking up and setting down the collecting container on the vehicle chassis, the hook lift arrangement having an angular arm that can be pivoted with respect to the vehicle, and includes a gripper hook on an end of the angular arm, and being configured to pivot freely with respect to the thrust cylinder.

* * * * *